US010818222B2

(12) United States Patent
Lee et al.

(10) Patent No.: US 10,818,222 B2
(45) Date of Patent: Oct. 27, 2020

(54) DISPLAY DEVICE

(71) Applicant: Samsung Display Co., Ltd., Yongin-si, Gyeonggi-do (KR)

(72) Inventors: Jeong Doo Lee, Yongin-si (KR); Sang Kuk Kim, Yongin-si (KR); Young Mook Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/595,110

(22) Filed: Oct. 7, 2019

(65) Prior Publication Data

US 2020/0193896 A1 Jun. 18, 2020

(30) Foreign Application Priority Data

Dec. 14, 2018 (KR) ..... 10-2018-0162365

(51) Int. Cl.
*G09G 3/32* (2016.01)

(52) U.S. Cl.
CPC ..... *G09G 3/32* (2013.01); *G09G 2310/08* (2013.01); *G09G 2330/06* (2013.01)

(58) Field of Classification Search
CPC .... G09G 3/32; G09G 3/3233; G09G 2310/08; G09G 2310/0218; G09G 2310/0262; G09G 2310/0235; G09G 2330/06; G09G 2330/025; G09G 2300/0819; G09G 2300/0417; G09G 2300/0852; G09G 2300/0443; G09G 2300/0452; G09G 2300/0842; G09G 2300/0861; G09G 2300/0814; G09G 2300/0804; G09G 2320/0666; G09G 2320/0606
See application file for complete search history.

(56) References Cited

U.S. PATENT DOCUMENTS

| | | | | |
|---|---|---|---|---|
| 9,418,589 | B2 | 8/2016 | Kim et al. | |
| 10,580,361 | B2 * | 3/2020 | Zhu | G09G 3/3225 |
| 10,665,152 | B2 * | 5/2020 | Cho | G09G 3/3216 |

(Continued)

FOREIGN PATENT DOCUMENTS

| | | | |
|---|---|---|---|
| KR | 10-2014-0014670 | A | 2/2014 |
| KR | 10-2015-0106371 | A | 9/2015 |
| KR | 10-1674606 | B1 | 11/2016 |

*Primary Examiner* — Christopher E Leiby
(74) *Attorney, Agent, or Firm* — Lewis Roca Rothgerber Christie LLP

(57) ABSTRACT

An embodiment of a display device includes first, second, and third pixels including first, second, and third transistors, a first light-emitting stage to apply a first light-emitting signal including a first pulse at a turn-off level to a gate electrode of the first transistor, a second light-emitting stage to apply a second light-emitting signal including a second pulse at a turn-off level to a gate electrode of the second transistor, and a third light-emitting stage to apply a third light-emitting signal including a third pulse at a turn-off level to a gate electrode of the third transistor, wherein an interval between generation times of the first and second pulses is the same as an interval between generation times of the second and third pulses, and an interval between extinction times of the first and second pulses is different from an interval between extinction times of the second and third pulses.

20 Claims, 10 Drawing Sheets

(56) References Cited

U.S. PATENT DOCUMENTS

| | | | | |
|---|---|---|---|---|
| 2006/0087478 | A1* | 4/2006 | Eom | G09G 3/3266 345/45 |
| 2012/0044240 | A1 | 2/2012 | Chung et al. | |
| 2012/0169574 | A1* | 7/2012 | Kim | G09G 3/3233 345/76 |
| 2013/0100007 | A1* | 4/2013 | Yamamoto | G09G 3/36 345/100 |
| 2013/0342584 | A1* | 12/2013 | Song | G09G 3/3266 345/690 |
| 2014/0055444 | A1* | 2/2014 | Jang | G09G 3/3291 345/213 |
| 2016/0307509 | A1 | 10/2016 | Nie | |
| 2017/0116920 | A1* | 4/2017 | Kwon | G09G 3/3266 |
| 2017/0154567 | A1* | 6/2017 | Ko | G06F 3/0412 |
| 2017/0200418 | A1* | 7/2017 | Zhang | G11C 19/28 |
| 2018/0096732 | A1* | 4/2018 | Cheng | G09G 3/20 |
| 2018/0130407 | A1* | 5/2018 | Zhai | G11C 19/28 |
| 2018/0130541 | A1* | 5/2018 | Li | G09G 5/003 |
| 2018/0174507 | A1* | 6/2018 | Ohara | G09G 3/3266 |
| 2019/0012948 | A1* | 1/2019 | Ohara | G09G 3/3258 |
| 2019/0096332 | A1* | 3/2019 | Park | G09G 3/3233 |
| 2020/0184892 | A1* | 6/2020 | Yang | G09G 3/3208 |

* cited by examiner

DISPLAY DEVICE

CROSS-REFERENCE TO RELATED APPLICATION

This application claims priority to, and the benefit of, Korean Patent Application No. 10-2018-0162365 filed in the Korean Intellectual Property Office on Dec. 14, 2018, the entire contents of which are incorporated herein by reference.

BACKGROUND

1. Field

The present disclosure relates to a display device.

2. Description of the Related Art

As information technology develops, the importance of a display device, which is a connection medium between users and information, has been highlighted. Therefore, a display device, such as a liquid crystal display device, an organic light emitting diode display device, and a plasma display device, has been increasingly used.

The display device may include a plurality of light-emitting lines. By transitioning a level of a light-emitting signal applied to each light-emitting line, it may be determined whether pixels are connected to a respective light-emitting line to emit light.

However, when transition times of light-emitting signals have a constant cycle, an electro-magnetic interference (EMI) noise of a frequency corresponding to the cycle may occur.

SUMMARY

Embodiments of the present disclosure provide a display device that is capable of reducing the maximum value of an EMI noise due to transitioning light-emitting signals.

A display device according to an embodiment of the present disclosure includes a first pixel including a first light-emitting diode, and a first light-emitting transistor for transferring a driving current to the first light-emitting diode when the first light-emitting transistor is turned on, a second pixel including a second light-emitting diode, and a second light-emitting transistor for transferring a driving current to the second light-emitting diode when the second light-emitting transistor is turned on, a third pixel including a third light-emitting diode, and a third light-emitting transistor for transferring a driving current to the third light-emitting diode when the third light-emitting transistor is turned on, a first light-emitting stage that is configured to apply a first light-emitting signal including a first pulse at a turn-off level to a gate electrode of the first light-emitting transistor, a second light-emitting stage that is configured to apply a second light-emitting signal including a second pulse at a turn-off level to a gate electrode of the second light-emitting transistor, and a third light-emitting stage that is configured to apply a third light-emitting signal including a third pulse at a turn-off level to a gate electrode of the third light-emitting transistor, wherein an interval between generation times of the first and second pulses is the same as an interval between generation times of the second and third pulses, and wherein an interval between extinction times of the first and second pulses is different from an interval between extinction times of the second and third pulses.

The interval between the extinction times of the first and second pulses may be shorter than the interval between the extinction times of the second and third pulses.

The interval between the extinction times of the first and second pulses may be longer than the interval between the extinction times of the second and third pulses.

The first, second, and third light-emitting stages may be configured to receive a first clock signal and a second clock signal, wherein the generation time of the first pulse is synchronized with a pulse of the second clock signal, wherein the extinction time of the first pulse is synchronized with a pulse of the first clock signal, wherein the generation time of the second pulse is synchronized with a pulse of the first clock signal, wherein the extinction time of the second pulse is synchronized with a pulse of the second clock signal, wherein the generation time of the third pulse is synchronized with a pulse of the second clock signal, and wherein the extinction time of the third pulse is synchronized with a pulse of the first clock signal.

The pulses of the first clock signal and the second clock signal synchronized with the generation times and the extinction times of the first, second, and third pulses may be different each other.

A display device according to an embodiment of the present disclosure includes a first pixel including a first light-emitting diode, and a first light-emitting transistor for transferring a driving current to the first light-emitting diode when the first light-emitting transistor is turned on, a second pixel including a second light-emitting diode, and a second light-emitting transistor for transferring a driving current to the second light-emitting diode when the second light-emitting transistor is turned on, a third pixel including a third light-emitting diode, and a third light-emitting transistor for transferring a driving current to the third light-emitting diode when the third light-emitting transistor is turned on, a first light-emitting stage that is configured to apply a first light-emitting signal including a first pulse at a turn-off level to a gate electrode of the first light-emitting transistor, a second light-emitting stage that is configured to apply a second light-emitting signal including a second pulse at a turn-off level to a gate electrode of the second light-emitting transistor, and a third light-emitting stage that is configured to apply a third light-emitting signal including a third pulse at a turn-off level to a gate electrode of the third light-emitting transistor, wherein an interval between generation times of the first and second pulses is different from an interval between generation times of the second and third pulses, and wherein an interval between extinction times of the first and second pulses is the same as an interval between extinction times of the second and third pulses.

The interval between the generation times of the first and second pulses may be shorter than the interval between the generation times of the second and third pulses.

The interval between the generation times of the first and second pulses may be longer than the interval between the generation times of the second and third pulses.

The first, second, and third light-emitting stages are configured to receive a first clock signal and a second clock signal, wherein the generation time of the first pulse is synchronized with a pulse of the second clock signal, wherein the extinction time of the first pulse is synchronized with a pulse of the first clock signal, wherein the generation time of the second pulse is synchronized with a pulse of the first clock signal, wherein the extinction time of the second pulse is synchronized with a pulse of the second clock signal, wherein the generation time of the third pulse is synchronized with a pulse of the second clock signal, and wherein the extinction time of the third pulse is synchronized with a pulse of the first clock signal.

The pulses of the first clock signal and the second clock signal that are respectively synchronized with the generation times and the extinction times of the first, second, and third pulses may be different each other.

A display device according to an embodiment of the present disclosure includes a first pixel including a first light-emitting diode, and a first light-emitting transistor for transferring a driving current to the first light-emitting diode when the first light-emitting transistor is turned on, a second pixel including a second light-emitting diode, and a second light-emitting transistor for transferring a driving current to the second light-emitting diode when the second light-emitting transistor is turned on, a third pixel including a third light-emitting diode, and a third light-emitting transistor for transferring a driving current to the third light-emitting diode when the third light-emitting transistor is turned on, a first light-emitting stage that is configured to apply a first light-emitting signal including a first pulse at a turn-off level to a gate electrode of the first light-emitting transistor, a second light-emitting stage that is configured to apply a second light-emitting signal including a second pulse at a turn-off level to a gate electrode of the second light-emitting transistor, and a third light-emitting stage that is configured to apply a third light-emitting signal including a third pulse at a turn-off level to a gate electrode of the third light-emitting transistor, wherein an interval between generation times of the first and second pulses is different from an interval between generation times of the second and third pulses, wherein an interval between extinction times of the first and second pulses is different from an interval between extinction times of the second and third pulses, and wherein the first and third light-emitting stages are light-emitting stages that are closest to the second light-emitting stage.

The interval between the extinction times of the first and second pulses may be shorter than the interval between the extinction times of the second and third pulses.

The interval between the generation times of the first and second pulses may be shorter than the interval between the generation times of the second and third pulses.

The first, second, and third light-emitting stages may be configured to receive a first clock signal and a second clock signal, wherein the generation time of the first pulse is synchronized with a pulse of the second clock signal, wherein the extinction time of the first pulse is synchronized with a pulse of the first clock signal, wherein the generation time of the second pulse is synchronized with a pulse of the first clock signal, wherein the extinction time of the second pulse is synchronized with a pulse of the second clock signal, wherein the generation time of the third pulse is synchronized with a pulse of the second clock signal, and wherein the extinction time of the third pulse is synchronized with a pulse of the first clock signal.

The pulses of the first clock signal and the second clock signal that are respectively synchronized with the generation times and the extinction times of the first, second, and third pulses may be different each other.

The interval between the extinction times of the first and second pulses may be longer than the interval between the extinction times of the second and third pulses.

The interval between the generation times of the first and second pulses may be longer than the interval between the generation times of the second and third pulses.

The first, second, and third light-emitting stages may be configured to receive a first clock signal and a second clock signal, wherein the generation time of the first pulse is synchronized with a pulse of the first clock signal, wherein the extinction time of the first pulse is synchronized with a pulse of the second clock signal, wherein the generation time of the second pulse is synchronized with a pulse of the second clock signal, wherein the extinction time of the second pulse is synchronized with a pulse of the first clock signal, wherein the generation time of the third pulse is synchronized with a pulse of the first clock signal, and wherein the extinction time of the third pulse is synchronized with a pulse of the second clock signal.

The pulses of the first clock signal and the second clock signal that are respectively synchronized with the generation times and the extinction times of the first, second, and third pulses may be different each other.

A width of each of the first, second, and third pulses may be the same.

Accordingly, a display device according to embodiments of the present disclosure may reduce the maximum value of an EMI noise due to the transitions of light-emitting signals.

DETAILED DESCRIPTION

Figure 1:
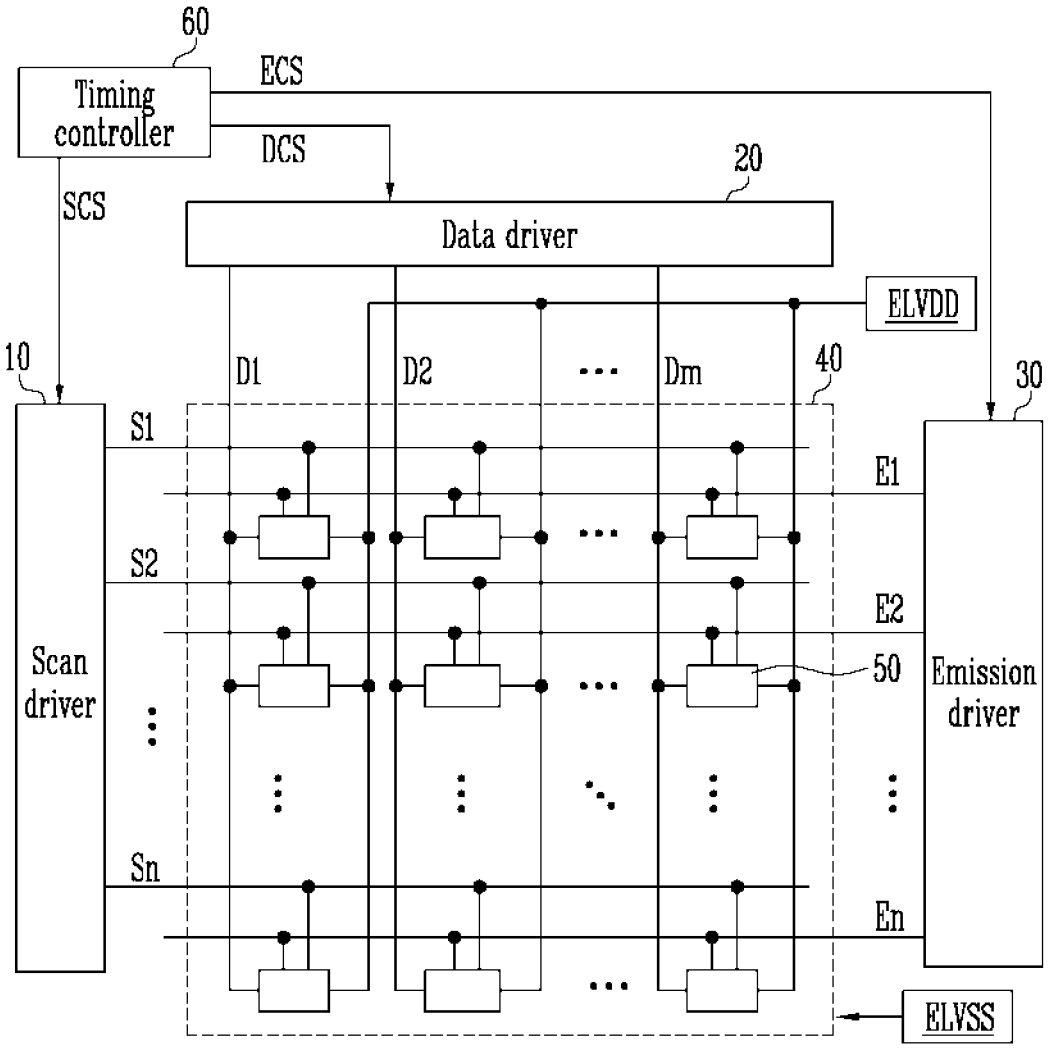
FIG. 1 is a drawing for illustrating a display device according to an embodiment of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory that may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a drawing for illustrating a display device according to an embodiment of the present disclosure.

Referring to FIG. 1, a display device according to an embodiment of the present disclosure may include a scan driver 10, a data driver 20, an emission driver 30, a display 40, and a timing controller 60.

The timing controller 60 may generate a data-driving control signal DCS, a scan-driving control signal SCS, and a light-emitting-driving control signal ECS in response to synchronous externally supplied signals. The data-driving control signal DCS generated by the timing controller 60 may be supplied to the data driver 20, the scan-driving control signal SCS may be supplied to the scan driver 10, and the light-emitting-driving control signal ECS may be supplied to the emission driver 30.

The scan-driving control signal SCS may include a start pulse and clock signals. The start pulse controls a first timing of a scan signal. The clock signals may be used to shift the start pulse or the scan signal to a next scan stage.

The light-emitting-driving control signal ECS may include a start pulse and clock signals. The start pulse controls a first timing of a light-emitting signal. The clock signals may be used to shift the start pulse or the light-emitting signal to a next light-emitting stage.

The data-driving control signal DCS may include a source start pulse and clock signals. The source start pulse controls a sampling starting time of data. The clock signals may be used to control a sampling operation.

The scan driver 10 may receive a scan-driving control signal SCS from the timing controller 60. The scan driver 10 receiving the scan-driving control signal SCS may supply the scan signals to scan lines S1-Sn, where n may be an integer that is greater than zero. For example, the scan driver 10 may supply scan pulses of a turn-on level sequentially to the scan lines S1-Sn. When the scan pulses are sequentially supplied to the scan lines S1-Sn, pixels 50 connected to the respective scan line may be selected.

The emission driver 30 may receive the light-emitting-driving control signal ECS from the timing controller 60. The emission driver 30 receiving the light-emitting-driving control signal ECS may supply light-emitting signals to light-emitting lines E1-En. For example, the emission driver 30 may sequentially supply light-emitting pulses of a turn-off level to the light-emitting lines E1-En. This light-emitting signal may be used to control an emission time of the pixels 50. For example, a pixel 50 receiving a light-emitting signal may be set to a non-emitting state during the period in which the light-emitting pulse of the turn-off level is supplied, and may be set to a light-emitting state during the other period.

The data driver 20 receives a data-driving control signal DCS from the timing controller 60. The data driver 20 receiving the data-driving control signal DCS supplies data signals to the data lines D1-Dm, where m may be an integer that is greater than zero. The data signals supplied to the data lines D1-Dm are supplied to pixels 50 selected by the scan signal. For this purpose, the data driver 20 may supply the data signals to the data lines D1-Dm to synchronize with the scan signal.

The display 40 includes pixels 50 connected to the scan lines S1-Sn, the data lines D1-Dm and the light-emitting lines E1-En. The display 40 may receive a first power supply ELVDD and a second power supply ELVSS.

Each of the pixels 50 may include a light-emitting diode and a light-emitting transistor. The light-emitting transistor may transfer a driving current to the light-emitting diode when the light-emitting transistor is turned on. The light-emitting diode may emit light (e.g., may emit light at a predetermined luminance) corresponding to the driving current.

Although FIG. 1 illustrates n scan lines S1-Sn and n light-emitting lines E1-En, the present disclosure is not limited thereto. For example, corresponding to a circuit structure of pixels 50 in other embodiments, at least one dummy scan line and/or one dummy light emitting control line may be additionally formed in the display 40.

Figure 2:
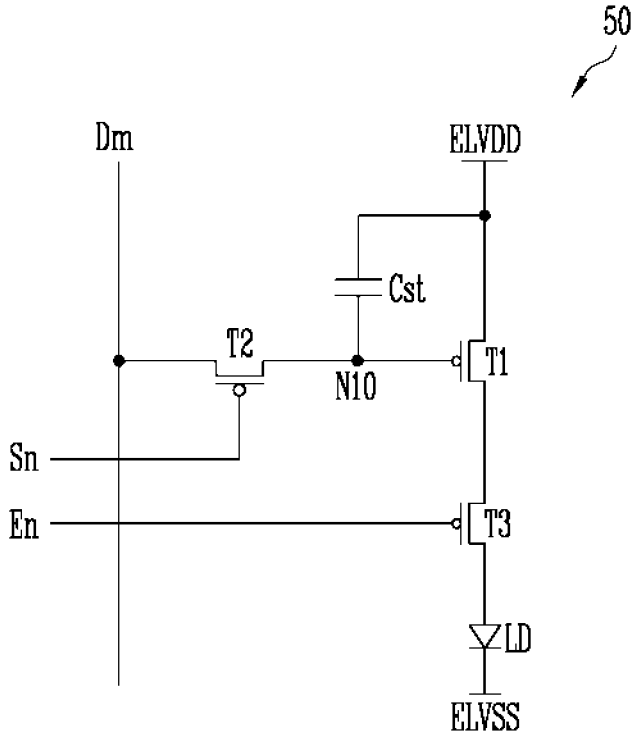
FIG. 2 is a drawing for illustrating a pixel according to an embodiment of the present disclosure.

FIG. 2 is a drawing for illustrating a pixel according to an embodiment of the present disclosure.

A pixel 50 connected to the n-th scan line Sn and the m-th data line Dm will be described with reference to FIG. 2. Substantially the same structure and driving method as the pixel 50 shown in FIG. 2 may be applied to other pixels 50.

Referring to FIG. 2, a pixel 50 according to an embodiment of the present disclosure may include a light-emitting diode LD, transistors T1, T2, and T3, and a storage capacitor Cst.

An anode of the light-emitting diode LD may be connected to a second electrode of the transistor T3, and a cathode of the light-emitting diode LD may be connected to the second power supply ELVSS. The light-emitting diode LD may generate light (e.g., light of a predetermined luminance) corresponding to an amount of a driving current supplied from the transistor T1. The light-emitting diode LD may be formed of an organic light-emitting diode or an inorganic light-emitting diode.

A first electrode of the transistor T1 may be connected to the first power supply ELVDD, and a second electrode of the transistor T1 may be connected to a first electrode of the transistor T3. In addition, a gate electrode of the transistor T1 may be connected to a node N10. This transistor T1 may control the amount of the driving current flowing from the first power supply ELVDD to the second power supply ELVSS via the transistor T3 and the organic light-emitting diode OLED in response to a voltage of the node N10. The transistor T1 may be referred to as a driving transistor.

A first electrode of the transistor T2 may be connected to the data line Dm, and a second electrode of the transistor T2 may be connected to the node N10. In addition, a gate electrode of the transistor T2 may be connected to the scan line Sn. This transistor T2 is turned on when a scan pulse of the turn-on level is supplied to the scan line (Sn), and can supply the data signal from the data line Dm to the node N10. The transistor T2 may be referred to as a scan transistor, a switching transistor, or the like.

A first electrode of the transistor T3 may be connected to a second electrode of the transistor T1, and a second electrode of the transistor T3 may be connected to the anode of the light-emitting diode LD. In addition, a gate electrode of the transistor T3 may be connected to the light-emitting line En. This transistor T3 may be turned off when the light-emitting pulse of the turn-off level is supplied to the light-emitting line En, and may be turned on when the light-emitting signal of the turn-on level is supplied to the light-emitting line En. The transistor T3 may be referred to as a light-emitting transistor.

In another embodiment of the present disclosure, the first electrode of the transistor T3 may be connected to the first power supply ELVDD, and the second electrode of the transistor T3 may be connected to the first electrode of the transistor T1.

When the transistor T3 is turned off, the transistor T1 and the light-emitting diode LD are electrically disconnected, so that the pixel 50 can be set to a non-emitting state. When the transistor T3 is turned on, the transistor T1 and the light-emitting diode LD are electrically connected, so that the pixel 50 may be set to a state capable of emitting light.

The storage capacitor Cst may be connected between the first power supply ELVDD and the node N10. The storage capacitor Cst may maintain a voltage of node N10.

It should be noted that the pixel 50 is not limited to the embodiment shown in FIG. 2. For example, in an embodiment of the present disclosure, a pixel may be implemented in various types of circuits in which an emission period may be controlled by a light emitting control signal.

In FIG. 2 and other figures of the present disclosure, transistors are shown as P-type transistors (e.g., PMOS). Therefore, the turn-on level may be a logic low level, and the turn-off level may be a logic high level. However, a person of ordinary skill in the art may derive a circuit that performs the same function as the disclosed embodiments by replacing at least one of the transistors with an N-type transistor (e.g., NMOS). In such embodiments, the turn-on level becomes a logic high level, and the turn-off level becomes a logic low level.

Figure 3:
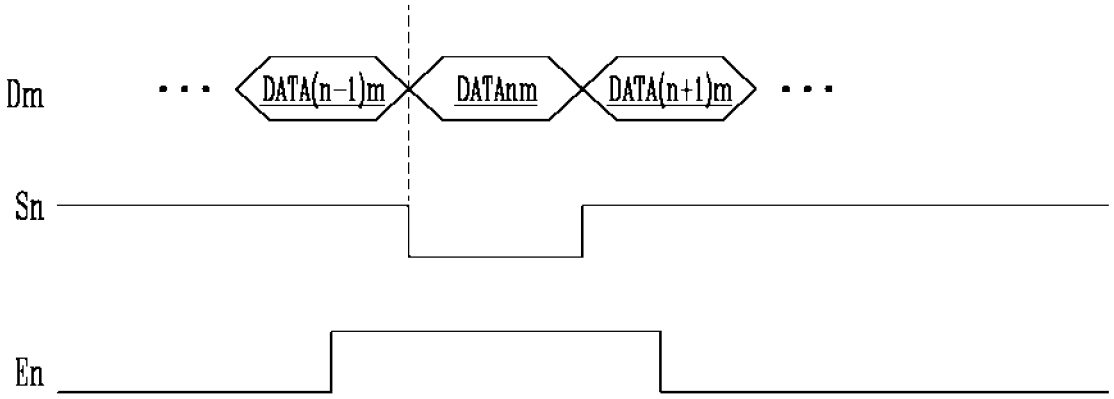
FIG. 3 is a drawing for illustrating a driving method of a pixel according to an embodiment of the present disclosure.

FIG. 3 is a drawing for illustrating a driving method of a pixel according to an embodiment of the present disclosure.

First, a light-emitting pulse of a turn-off level may occur in the light-emitting line En. Thus, the transistor T3 may be turned off, and the light-emitting diode LD may be turned off.

Next, a scan pulse of a turn-on level may occur in the scan line Sn.

Accordingly, the transistor T2 may be turned on, and a data signal DATAnm applied to the data line Dm at that time may be transferred to the node N10. The storage capacitor Cst may maintain the data signal applied to the node N10.

Next, the light-emitting pulse of the light-emitting line En (e.g., the light-emitting pulse of a turn-off level) may cease to be applied. Accordingly, a light-emitting signal of a turn-on level may be applied to the light-emitting line En, and the transistor T3 may be turned on. Accordingly, a driving current path including the first power supply ELVDD, the transistor T1, the transistor T3, the light-emitting diode LD, and the second power supply ELVSS may allow the driving current to flow. The light-emitting diode LD may emit light (e.g., with a predetermined luminance) based on the voltage of the node N10 maintained by the storage capacitor Cst.

Figure 4:
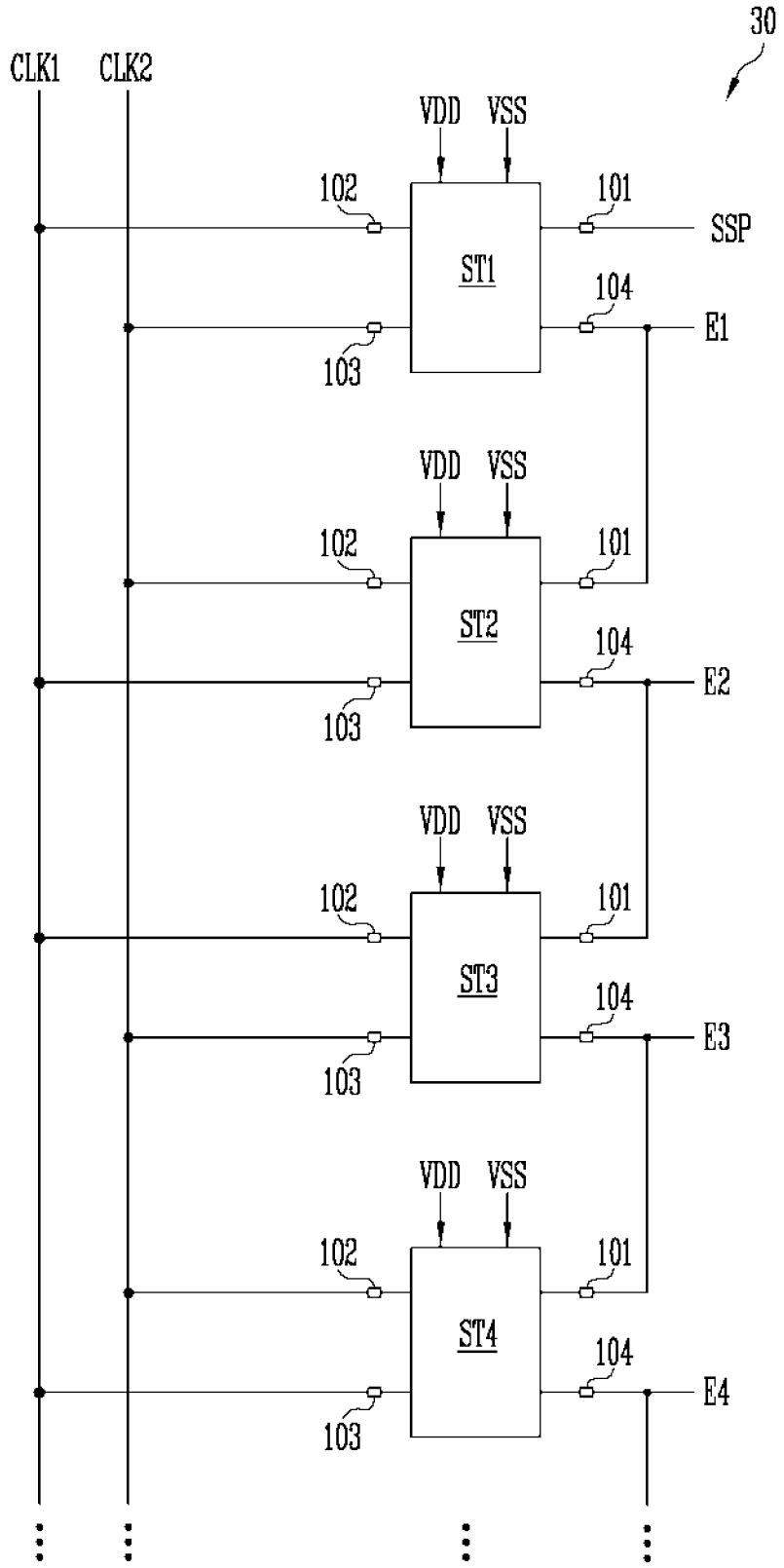
FIG. 4 is a drawing for illustrating an emission driver according to an embodiment of the present disclosure.

FIG. 4 is a drawing for illustrating an emission driver according to an embodiment of the present disclosure. FIG. 4 shows four light-emitting stages ST1-ST4 for better understanding and ease of description.

Referring to FIG. 4, the emission driver 30 according to an embodiment of the present disclosure may include a plurality of light-emitting stages ST1-ST4. The light-emitting stages ST1 to ST4 may be connected to the corresponding light-emitting lines E1 to E4, respectively, and may be commonly connected to clock lines CLK1 and CLK2. The light-emitting stages ST1-ST4 may have a substantially the same circuit structure.

Each of the light-emitting stages ST1-ST4 may include a first input terminal 101, a second input terminal 102, a third input terminal 103, and an output terminal 104.

The first input terminal 101 may receive a start pulse SSP or an output signal (e.g., a light-emitting signal) of a preceding (e.g., immediately previous) light-emitting stage. For example, a first input terminal 101 of a first light-emitting stage ST1 may receive a start pulse SSP, and first input terminals 101 of the other light-emitting stages ST2-ST4 may receive a light-emitting signal of a respective previous light-emitting stage.

A second input terminal 102 of the j-th light-emitting stage STj (j may be odd or even) may be connected to the first clock line CLK1, and a third input terminal 103 thereof may be connected to the second clock line CLK2. Contrastingly, a second input terminal 102 of the j+1-th light-emitting stage STj+1 may be connected to the second clock line CLK2, and a third input terminal 103 thereof may be connected to the first clock line CLK1. That is, the first clock line CLK1 and the second clock line CLK2 may be alternately connected to the second input terminal 102 and the third input terminal 103 the light-emitting stages, respectively.

Pulses of a first clock signal applied to the first clock line CLK1, and the pulses of a second clock signal applied to the second clock line CLK2, do not overlap each other in terms of time. Each of the pulses may be a turn-on level.

The light-emitting stages ST1 to ST4 may receive the first power supply VDD and the second power supply VSS. The first power supply VDD may be set to a voltage of a turn-off level, and the second power supply VSS may be set to a voltage of a turn-on level. A voltage level may be determined based on one of the first power supply VDD and second power supply VSS.

Figure 5:
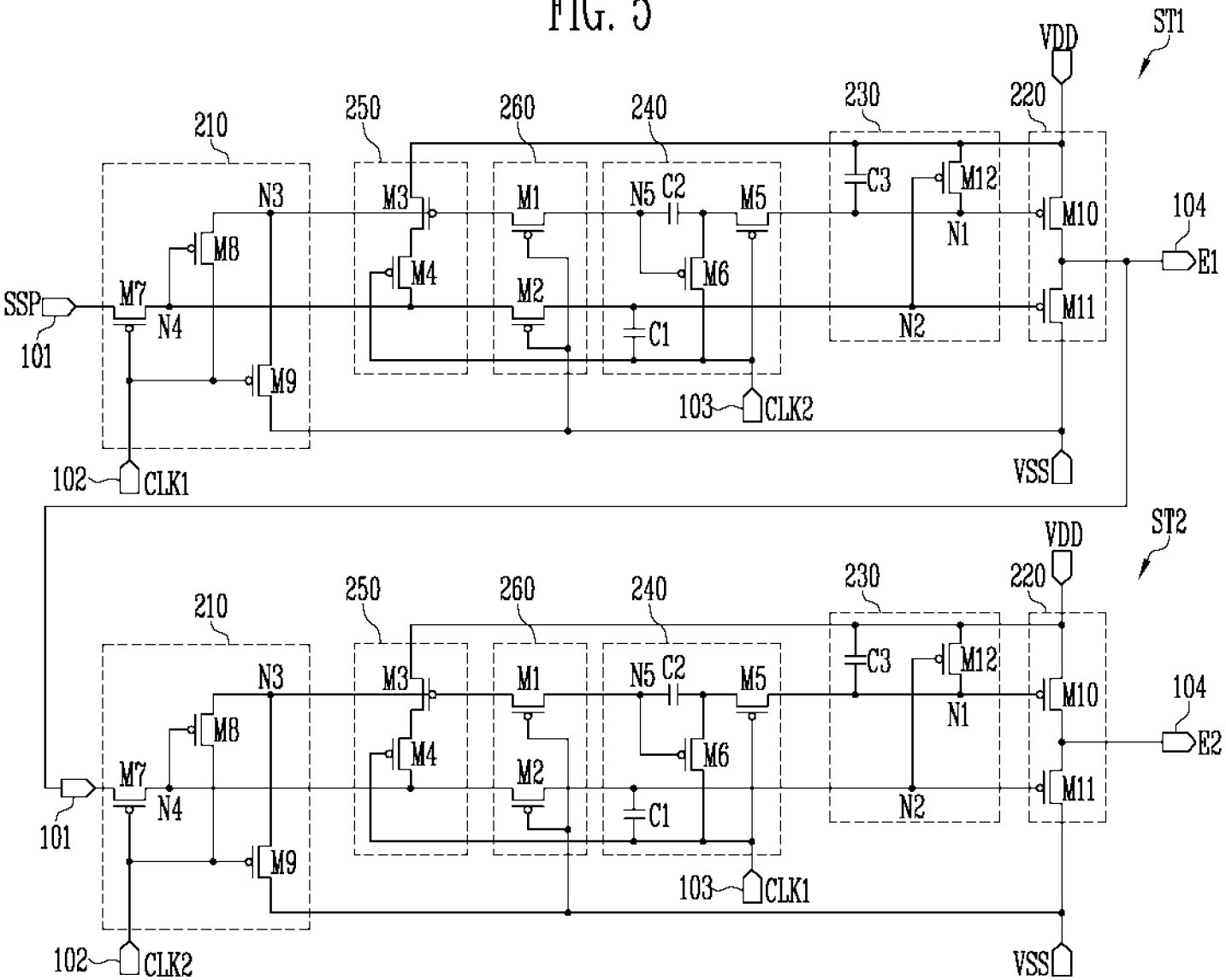
FIG. 5 is a drawing for illustrating light-emitting stages according to an embodiment of the present disclosure.

FIG. 5 is a drawing for illustrating light-emitting stages according to an embodiment of the present disclosure. FIG. 5 shows two light-emitting stages ST1 and ST2 for better understanding and ease of description.

Referring to FIG. 5, the first light-emitting stage ST1 according to an embodiment of the present disclosure may include an input unit 210, an output unit 220, a first signal processor 230, a second signal processor 240, a third signal processor 250, and a first stabilization unit 260.

The output unit 220 may supply a voltage of the first power supply VDD or the second power supply VSS to the output terminal 104 in response to a voltage of a first node N1 and a second node N2. For this purpose, the output unit 220 may include a tenth transistor M10 and an eleventh transistor M11.

The tenth transistor M10 may be connected between the first power supply VDD and the output terminal 104. In addition, a gate electrode of the tenth transistor M10 may be connected to the first node N1. The tenth transistor M10 may be turned on or off in response to a voltage of the first node N1. Here, when the tenth transistor M10 is turned on, a voltage of the first power supply VDD supplied to the output terminal 104 may be output as a light-emitting signal of a turn-off level through the first light-emitting line E1.

The eleventh transistor M11 may be connected between the output terminal 104 and the second power supply VSS. In addition, a gate electrode of the eleventh transistor M11 may be connected to the second node N2. The eleventh transistor M11 may be turned on or off in response to a voltage of the second node N2. Here, when the eleventh transistor M11 is turned on, a voltage of the second power supply VSS supplied to the output terminal 104 may be output as a light-emitting signal of a turn-on level through the first light-emitting line E1.

The input unit 210 may control a voltage of a third node N3 and a fourth node N4 in response to signals respectively supplied to the first input terminal 101 and the second input terminal 102. For this purpose, the input unit 210 may include a seventh transistor M7, an eighth transistor M8, and a ninth transistor M9.

The seventh transistor M7 may be connected between the first input terminal 101 and the fourth node N4. In addition, a gate electrode of the seventh transistor M7 may be connected to the second input terminal 102. This seventh transistor M7 may be turned on when the first clock signal of the turn-on level is supplied to the second input terminal 102 to electrically connect the first input terminal 101 and the fourth node N4.

The eighth transistor M8 may be connected between the third node N3 and the second input terminal 102. In addition, a gate electrode of the eighth transistor M8 may be connected to the fourth node N4. This eighth transistor M8 may be turned on or off in response to a voltage of the fourth node N4.

The ninth transistor M9 may be connected between the third node N3 and the second power supply VSS. A gate electrode of the ninth transistor M9 may be connected to the second input terminal 102. This ninth transistor M9 may be turned on when the first clock signal of the turn-on level is supplied to the second input terminal 102 to supply the voltage of the second power supply VSS to the third node N3.

The first signal processor 230 may control the voltage of the first node N1 in response to the voltage of the second node N2. For this purpose, the first signal processor 230 may include a twelfth transistor M12 and a third capacitor C3.

The twelfth transistor M12 may be connected between the first power supply VDD and the first node N1. In addition, a gate electrode of the twelfth transistor M12 may be connected to the second node N2. The twelfth transistor M12 may be turned on or off in response to the voltage of the second node N2.

The third capacitor C3 may be connected between the first power supply VDD and the first node N1. The third capacitor C3 may maintain the voltage applied to the first node N1.

The second signal processor 240 may be connected to a fifth node N5, and may control the voltage of the first node N1 in response to a signal supplied to the third input terminal 103. For this purpose, the second signal processor 240 may include a fifth transistor M5, a sixth transistor M6, a first capacitor C1, and a second capacitor C2.

The first capacitor C1 may be connected between the second node N2 and the third input terminal 103. The first capacitor C1 may maintain a voltage difference between the third input terminal 103 and the second node N2.

A first terminal of the second capacitor C2 may be connected to the fifth node N5, and a second terminal of the second capacitor C2 may be connected to the fifth transistor M5.

The fifth transistor M5 may be connected between a second terminal of the second capacitor C2 and the first node N1. In addition, a gate electrode of the fifth transistor M5 may be connected to the third input terminal 103. The fifth transistor M5 may be turned on when the second clock signal is supplied to the third input terminal 103 to electrically connect the second terminal of the second capacitor C2 to the first node N1.

The sixth transistor M6 may be connected between the second terminal of the second capacitor C2 and the third input terminal 103. In addition, a gate electrode of the sixth transistor M6 may be connected to the fifth node N5.

The third signal processor 250 may control the voltage of the fourth node N4 in response to the voltage of the third node N3 and to a signal supplied to the third input terminal 103. For this purpose, the third signal processor 250 may include a third transistor M3 and a fourth transistor M4.

The third transistor M3 and the fourth transistor M4 may be connected in series between the first power supply VDD and the fourth node N4. A gate electrode of the third transistor M3 may be connected to the third node N3. In addition, a gate electrode of the fourth transistor M4 may be connected to the third input terminal 103.

The first stabilization unit 260 may be connected between the second signal processor 240 and the input unit 210. The first stabilization unit 260 may limit a voltage drop width of the third node N3 and the fourth node N4. The first stabilization unit 260 may include a first transistor M1 and a second transistor M2.

The first transistor M1 may be connected between the third node N3 and the fifth node N5. In addition, a gate electrode of the first transistor M1 may be connected to the second power supply VSS. The second transistor M2 may be connected between the second node N2 and the fourth node N4. In addition, a gate electrode of the second transistor M2 may be connected to the second power supply VSS.

Meanwhile, the second light-emitting stage ST2 may be substantially the same as the first light-emitting stage ST1, with the exception that signals supplied to the first input terminal 101, the second input terminal 102 and the third input terminal 103 may be different (e.g., the first and second clock signals applied to the second and third input terminals 102 and 103 may be switched). Therefore, a duplicate description of the second light-emitting stage ST2 will be omitted.

Figure 6:
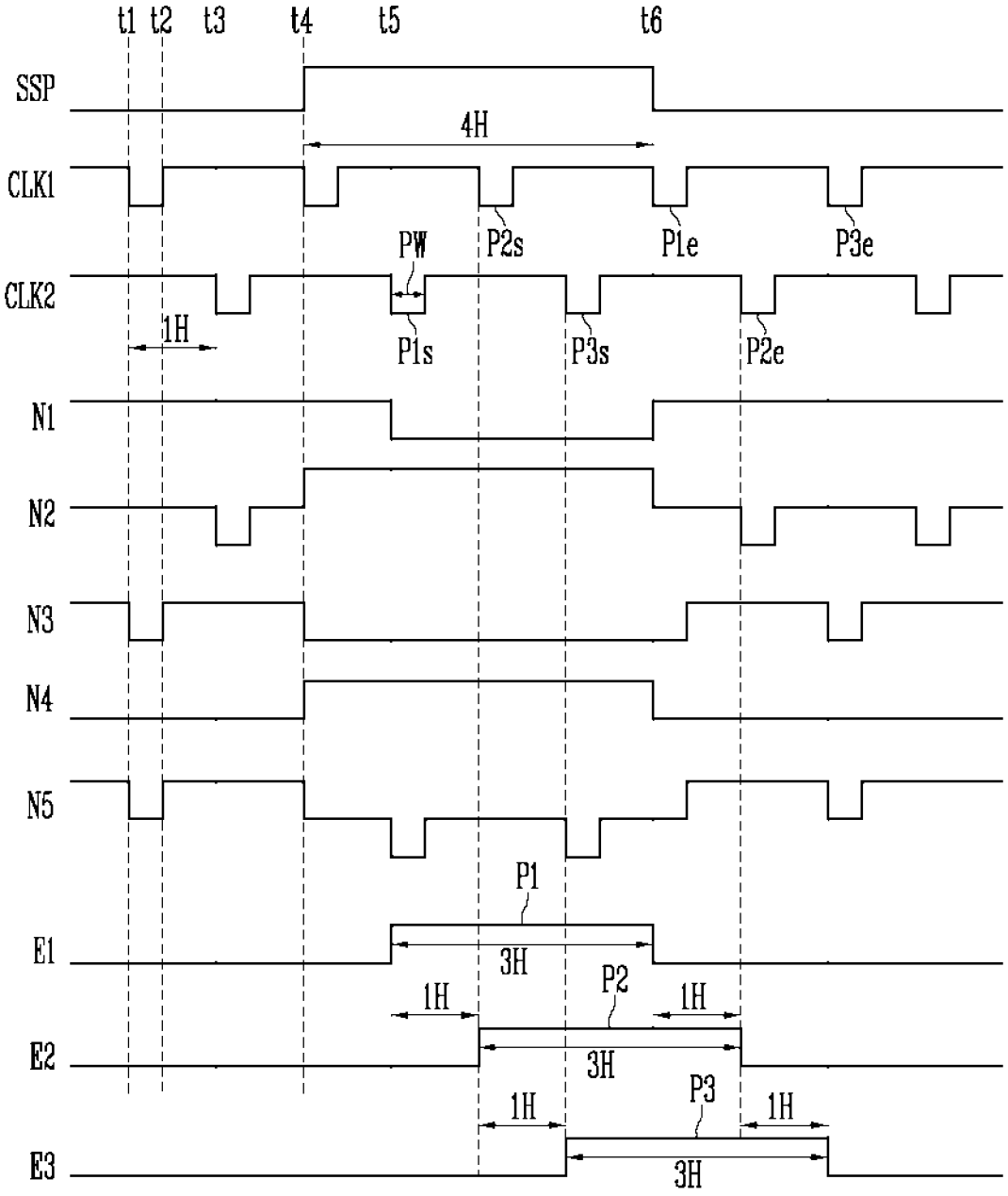
FIG. 6 is a drawing for illustrating a driving method of the light-emitting stages of FIG. 5.

FIG. 6 is a drawing for illustrating a driving method of the light-emitting stages of FIG. 5.

FIG. 6 illustrates an operation procedure with reference to the first light-emitting stage ST1.

Referring to FIG. 6, the pulses of the first clock signal and the pulses of the second clock signal each have a cycle of two horizontal periods, respectively, and occur in different horizontal periods. For example, the pulse of the second clock signal may be a signal shifted by a half cycle (e.g., shifted by one horizontal period 1H) with reference to the pulse of the first clock signal.

A start pulse SSP of a high level supplied to the first input terminal 101 is set to overlap a pulse of a low level of the first clock signal supplied to the second input terminal 102 at least once. For this purpose, the start pulse SSP may be supplied to have a wider width than the first clock signal. For example, the start pulse SSP may be supplied for 4 horizontal periods 4H. In addition, a pulse P1 of a first light-emitting signal supplied to the first input terminal 101 of the second light-emitting stage ST2 may overlap a pulse of a low level of the second clock signal supplied to the second input terminal 102 of the second light-emitting stage ST2 at least once.

First, a first clock signal of a low level is supplied to the second input terminal 102 at a first time t1. That is, a pulse may occur at the first clock signal. Therefore, the seventh transistor M7 and the ninth transistor M9 may be turned on.

When the seventh transistor M7 is turned on, the first input terminal 101 and the fourth node N4 may be electrically connected. Here, because the second transistor M2 remains in a turn-on state, the first input terminal 101 may be electrically connected to the second node N2 via the fourth node N4. During the first time t1, a start pulse SSP of a high level is not supplied to the first input terminal 101, so that a voltage of a low level (e.g., VSS) may be supplied to the fourth node N4 and the second node N2.

When the voltage of the low level is applied to the second node N2 and the fourth node N4, the eighth transistor M8, the eleventh transistor M11, and the twelfth transistor M12 may be turned on.

When the twelfth transistor M12 is turned on, the voltage of the first power supply VDD is supplied to the first node N1, so that the tenth transistor M10 may be turned off.

When the eleventh transistor M11 is turned on, the voltage of the second power supply VSS may be supplied to the output terminal 104. Therefore, a light-emitting signal of a low level may be supplied to the first light-emitting line E1 at the first time t1.

When the eighth transistor M8 is turned on, the first clock signal is supplied to the third node N3. Here, because the first transistor M1 is maintained in a turn-on state, the first clock signal may be supplied to the fifth node N5 via the third node N3.

Meanwhile, when the ninth transistor M9 is turned on, the voltage of the second power supply VSS is supplied to the third node N3 and the fifth node N5. Here, the first clock signal may be a low level, so that the third node N3 and the fifth node N5 may be stably charged to the voltage of the second power supply VSS. Thus, the third transistor M3 and the sixth transistor M6 are turned on.

When the sixth transistor M6 is turned on, the second clock signal of a high level (e.g., VDD) is supplied from the third input terminal 103 to the second terminal of the second capacitor C2. At this time, because the fifth transistor M5 is in the turn-off state, the first node N1 may maintain the voltage of the first power supply VDD regardless of a voltage of the fifth node N5 and the second terminal of the second capacitor C2.

When the third transistor M3 is turned on, the voltage of the first power supply VDD may be supplied to the fourth transistor M4. At this time, the fourth transistor M4 is in the turn-off state, so that the fourth node N4 may maintain a low level.

At a second time t2, the first clock signal of a high level is supplied to the second input terminal 102. That is, a pulse of the first clock signal may cease. Thus, the seventh transistor M7 and the ninth transistor M9 may be turned off. At this time, the second node N2 and the first node N1 may maintain a previous voltage by the first capacitor C1 and the third capacitor C3, and the eighth transistor M8, the eleventh transistor M11, and the twelfth transistor M12 may maintain the turn-on state.

When the eighth transistor M8 is turned on, the first clock signal of a high level is supplied from the second input terminal 102 to the third node N3 and the fifth node N5. Thus, the third transistor M3 and the sixth transistor M6 are set in the turn-off state.

At a third time t3, the second clock signal of a low level is supplied to the third input terminal 103. That is, a pulse of the second clock signal occurs/begins. Therefore, the fourth transistor M4 and the fifth transistor M5 are turned on.

When the fifth transistor M5 is turned on, the second terminal of the second capacitor C2 is electrically connected to the first node N1. At this time, because the twelfth transistor M12 is in the turn-on state, the first node N1 maintains the voltage of the first power supply VDD.

When the fourth transistor M4 is turned on, the second electrode of the third transistor M3 and the second node N2 are electrically connected. At this time, because the third transistor M3 is in the turn-off state, the voltage of the first power supply VDD is not supplied to the fourth node N4 and the second node N2.

When the second clock signal of a low level is supplied to the third input terminal 103, the second node N2 drops to a voltage that is lower than the second power supply VSS due to a coupling of the first capacitor C1. Accordingly, a voltage applied to a gate electrode of the eleventh transistor M11 and the twelfth transistor M12 is lower than the second power supply VSS, thereby improving driving characteristics of the transistors.

The fourth node N4 may maintain the voltage of the second power supply VSS (e.g., a voltage of a low level) due to the second transistor M2, regardless of a voltage drop of the second node N2. That is, because the voltage of the second power supply VSS is continuously applied to the gate electrode of the second transistor M2, the voltage of the fourth node N4 corresponding to the source electrode of the second transistor M2 does not drop below a value obtained by adding a threshold voltage to the voltage of the second power supply VSS. Therefore, a voltage difference between the first electrode and the second electrode of the seventh transistor M7 is reduced or minimized, thereby preventing characteristics of the seventh transistor M7 from being changed.

At a fourth time t4, the start pulse SSP of a high level is supplied to the first input terminal 101, and the first clock signal of a low level is supplied to the second input terminal 102. That is, a new pulse occurs in the first clock signal. Therefore, the seventh transistor M7 and the ninth transistor M9 are turned on.

When seventh transistor M7 is turned on, the first input terminal 101 is electrically connected to the fourth node N4 and the second node N2. Therefore, the fourth node N4 and the second node N2 are charged to a voltage of a high level, and the eighth transistor M8, the eleventh transistor M11, and the twelfth transistor M12 are turned off.

When the ninth transistor M9 is turned on, the voltage of the second power supply VSS is supplied to the third node N3 and the fifth node N5, and the third transistor M3 and the sixth transistor M6 are turned on. At this time, even if the third transistor M3 is turned on, the voltage of the fourth node N4 is maintained because the fourth transistor M4 is in the turn-off state.

When the sixth transistor M6 is turned on, the second terminal of the second capacitor C2 and the third input terminal 103 are electrically connected. At this time, because the fifth transistor M5 is in the turn-off state, the first node N1 maintains a high level.

At a fifth time t5, the second clock signal of a low level is supplied to the third input terminal 103. That is, a new pulse P1*s* occurs in the second clock signal. Therefore, the fourth transistor M4 and the fifth transistor M5 are turned on. At this time, the third node N3 and the fifth node N5 are charged with the voltage of the second power supply VSS, so that the third transistor M3 and the sixth transistor M6 are turned on.

The second clock signal of a low level is applied to the first node N1 via the turned-on fifth transistor M5 and sixth transistor M6, and then the tenth transistor M10 is turned on. When the tenth transistor M10 is turned on, the voltage of the first power supply VDD is supplied to the output terminal 104 as a light-emitting signal. Therefore, a light-emitting signal of a high level may be supplied to the first light-emitting line E1.

When the third transistor M3 and the fourth transistor M4 are turned on, the voltage of the second power supply VDD is supplied to the fourth node N4 and the second node N2. Thus, the eighth transistor M8 and the eleventh transistor M11 may stably maintain the turn-off state.

Meanwhile, when the second clock signal of a low level is supplied to the second terminal of the second capacitor C2, the voltage of the fifth node N5 drops to a voltage that is lower than the second power supply VSS due to a coupling of the second capacitor C2. Accordingly, a voltage applied to a gate electrode of the sixth transistor M6 drops to a voltage that is lower than the second power supply VSS, and driving characteristics of the sixth transistor M6 may be improved.

Regardless of the voltage of the fifth node N5 due to the first transistor M1, the voltage of the third node N3 may approximately maintain the voltage of the second power supply VSS. That is, because the voltage of the second power supply VSS is continuously applied to the gate electrode of the first transistor M1, the voltage of the third node N3 corresponding to the source electrode of the first transistor M1 does not drop below a value obtained by adding a threshold voltage to the voltage of the second power supply VSS. Therefore, regardless of a voltage drop of the fifth node N5, the third node N3 may approximately maintain the voltage of the second power supply VSS. In this case, a voltage difference between a source electrode and a drain electrode of the eighth transistor M8 is reduced or minimized, thereby preventing characteristics of the eighth transistor M8 from being changed.

At a sixth time t6, the first clock signal of a low level is supplied to the second input terminal 102. That is, a new pulse P1*e* may occur in the first clock signal. Therefore, the seventh transistor M7 and the ninth transistor M9 are turned on.

When seventh transistor M7 is turned on, the fourth node N4 and the second node N2 are electrically connected to the first input terminal 101, so that a voltage of a low level of the first input terminal 101 is supplied to the fourth node N4 and the second node N2. Thus, the eighth transistor M8, the eleventh transistor M11, and the twelfth transistor M12 are turned on.

When the eighth transistor M8 is turned on, the first clock signal of a low level is supplied to the third node N3 and the fifth node N5.

When the twelfth transistor M12 is turned on, the voltage of the first power supply VDD is supplied to the first node N1, and then the tenth transistor M10 is turned off.

When the eleventh transistor M11 is turned on, the voltage of the second power supply VSS is supplied to the output terminal 104. Therefore, the light-emitting signal of a low level may be supplied to the first light-emitting line E1.

Meanwhile, the second light-emitting stage ST2, which receives the light-emitting signal from the output terminal 104 of the first light-emitting stage ST1, supplies the light-emitting signal to a second light-emitting line E2 while repeating the above-described process. That is, the light-emitting stages ST according to an embodiment of the present disclosure may supply light-emitting signals to the light-emitting lines E1-En while repeating the above-described process.

As described above, the generation time of the first pulse P1 of the light-emitting signal applied to the first light-emitting line E1 is synchronized with the pulse P1*s* of the second clock signal applied to the third input terminal 103, and the extinction time of the first pulse P1 of the light-emitting signal is synchronized with the pulse P1*e* of the first clock signal applied to the second input terminal 102.

Similarly, a generation time of a second pulse P2 of the light-emitting signal applied to the second light-emitting line E2 is synchronized with a pulse P2*s* of the first clock signal applied to the third input terminal 103, and an extinction time of the second pulse P2 of the light-emitting signal applied to the second light-emitting line E2 is synchronized with a pulse P2*e* of the second clock signal applied to the second input terminal 102.

In addition, a generation time of a third pulse P3 of the light-emitting signal applied to a third light-emitting line E3 is synchronized with a pulse P3*s* of the second clock signal applied to the third input terminal 103, and an extinction time of the third pulse P3 of the light-emitting signal applied to a third light-emitting line E3 is synchronized with a pulse P3*e* of the first clock signal applied to the second input terminal 102.

That is, as described above, because the pulses of the clock signal that define the generation times and extinction times of the pulses P1, P2, and P3 of the light-emitting signals are different from each other, it can be seen that the generation times and the extinction times of the pulses P1, P2, and P3 of the light-emitting signals can be independently controlled by controlling the timing of the pulses of the clock signal.

An interval between the generation times of the first and second pulses P1 and P2 may be the same as an interval between the generation times of the second and third pulses P2 and P3. For example, the interval between the generation times of the first and second pulses P1 and P2 may be 1 horizontal cycle 1H, and the interval between the generation times of the second and third pulses P2 and P3 may be also 1 horizontal cycle 1H.

In addition, an interval between the extinction times of the first and second pulses P1 and P2 may be the same as an interval between the extinction times of the second and third pulses P2 and P3. For example, the interval between the extinction times of the first and second pulses P1 and P2 may be 1 horizontal cycle 1H, and the interval between the extinction times of the second and third pulses P2 and P3 may be 1 horizontal cycle 1H.

In this case, transition points of the light-emitting signals have a certain period (e.g., 1 horizontal period), and electromagnetic interference (EMI) noise of a frequency corresponding to the period is generated. For example, in a case where an ultra-high definition (UHD) display device with 2160 pixel rows is driven at a frequency of 60 Hz, a transition from a high level to a low level occurs in each light-emitting line with a cycle of 1/60*(1/2160) seconds, and the display device may have a noise peak value at a frequency of 129.6 KHz, which is a reciprocal of the cycle.

Figure 7:
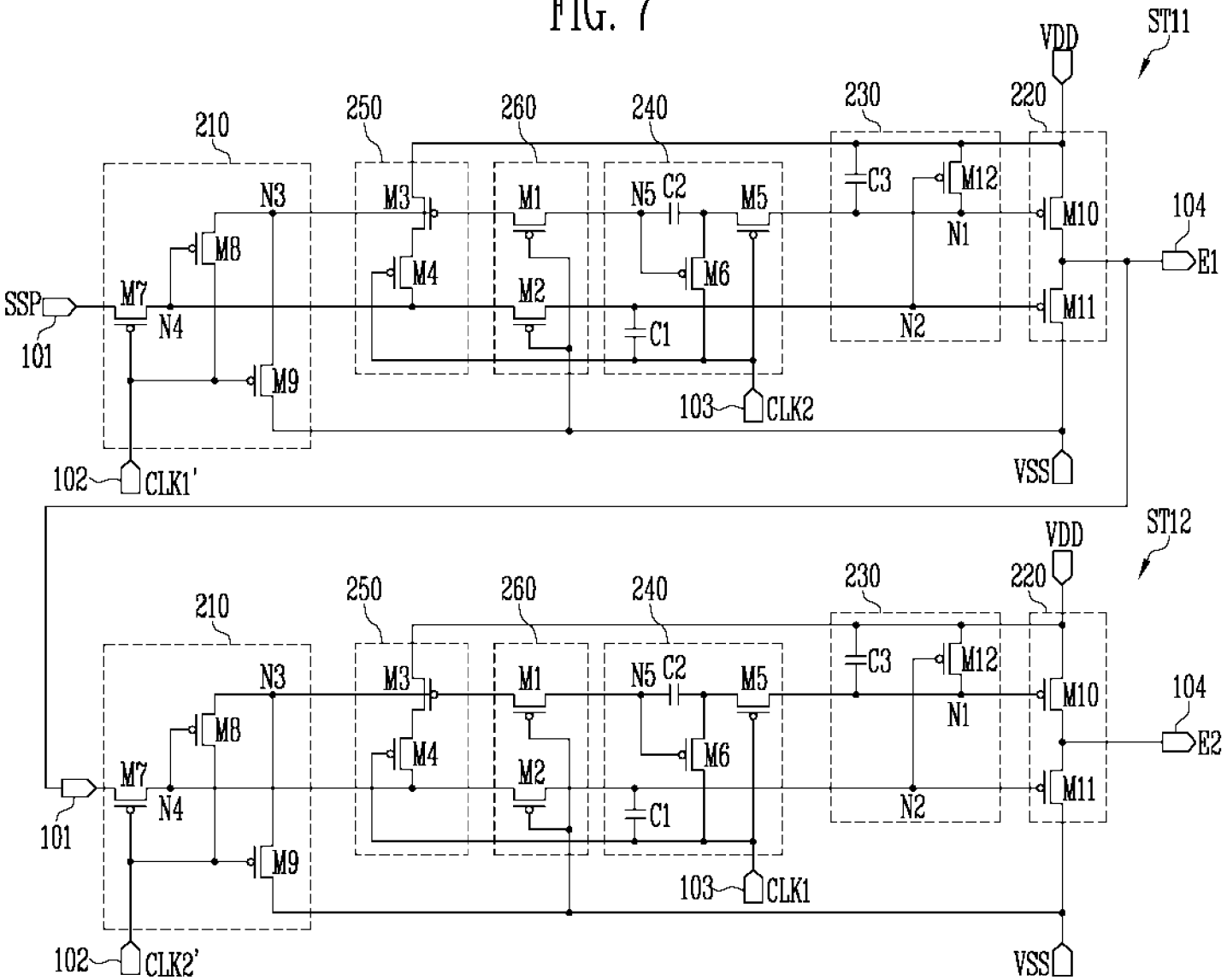
FIG. 7 is a drawing for illustrating light-emitting stages according to a first embodiment of the present disclosure.

FIG. 7 is a drawing for illustrating light-emitting stages according to a first embodiment of the present disclosure.

Referring to FIG. 7, light-emitting stages of FIG. 7 are different from the light-emitting stages ST1 and ST2 of FIG. 5 in that a first clock line CLK1' and a second clock line CLK2' are connected to second input terminals 102 of the light-emitting stages ST11 and ST12 respectively.

That is, the emission driver 30 of FIG. 7 uses four clock lines CLK1, CLK2, CLK1', and CLK2'. As described in FIG. 6, the clock signal applied to the third input terminal 103 of each light-emitting stage defines the generation time of the pulse of the corresponding light-emitting signal, and the clock signal applied to the second input terminal 102 defines the extinction, or end, of the pulse of the corresponding light-emitting signal.

In an embodiment of the present disclosure, the timing of the pulses of the clock signals applied to the clock lines CLK1 and CLK2 connected to the respective third input terminals 103 may be the same as the timing shown in FIG. 6. Therefore, the generation times of pulses of light-emitting signals may be the same as the generation times shown in FIG. 6.

However, according to an embodiment of the present disclosure, by controlling the timing of the pulses of the clock signals applied to the clock lines CLK1' and CLK2' connected to the respective second input terminals 102, the extinction times of the pulses of the light-emitting signals may be controlled.

Figure 8:
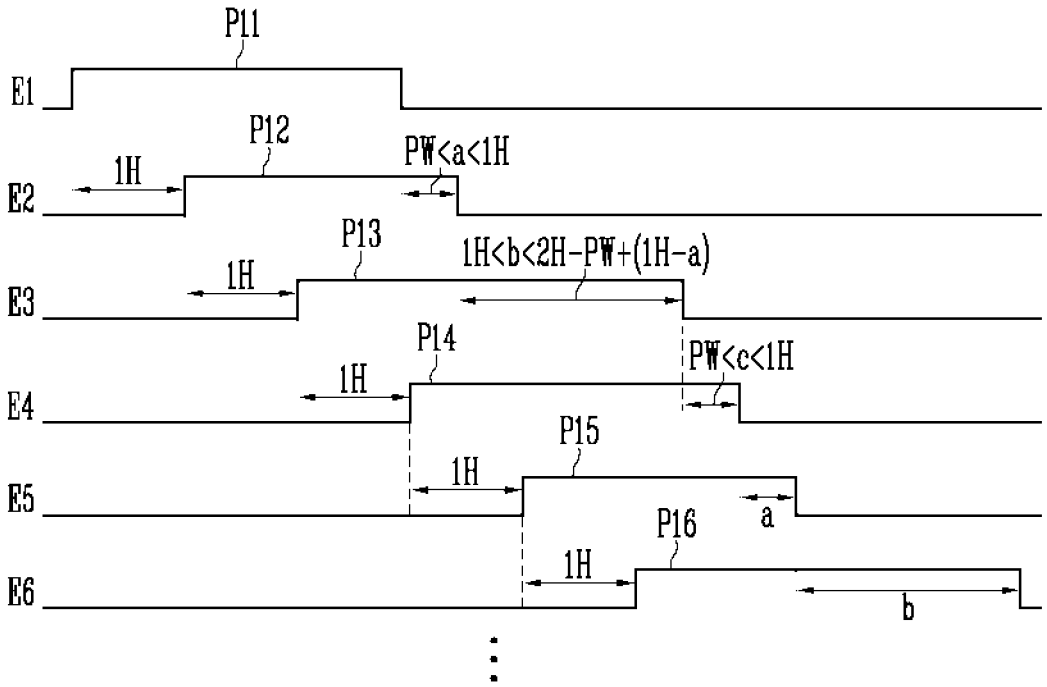
FIG. 8 is a drawing for illustrating a driving method of light-emitting stages according to the first example of the present disclosure.

FIG. 8 is a drawing for illustrating a driving method of light-emitting stages according to the first example of the present disclosure.

In a first embodiment, the interval between the generation times of the first and second pulses P11 and P12 is the same as the interval between the generation times of the second and third pulses P12 and P13. For example, the interval between the generation time of the first and second pulses P11 and P12 and the interval between the generation time of the second and third pulses P12 and P13 may be one horizontal cycle 1H.

In addition, an interval "a" between the extinction times of the first and second pulses P11 and P12 is different from an interval "b" between the extinction times of the second and third pulses P12 and P13. For example, the interval "a" between the extinction times of the first and second pulses P11 and P12 may be shorter than the interval "b" between the extinction times of the second and third pulses P12 and P13. For example, the interval "a" between the extinction times of the first and second pulses P11 and P12 may be less than one horizontal cycle 1H. At this time, the interval "b" between the extinction times of the second and third pulses P12 and P13 may be more than one horizontal cycle 1H.

However, as described in a driving method of FIG. 6, there may be some limitations in controlling the timing of the pulses of the first and second clock signals. For example, the pulses of the first clock signal cannot overlap the pulse of the second clock signal that is closest in time. In addition, the pulses of the second clock signal cannot overlap the pulse of the first clock signal that is closest in time. When overlapping, high and low voltages may be applied to the same node at the same time.

Therefore, if the pulses of the first and second clock signals have a constant width PW, the interval "a" may be in a range of PW<a<1H. For example, the pulse P2*e* defining the interval "a" may occur earlier than in the embodiment of FIG. 6, but the interval "a" is greater than the width PW of the pulse Pie such that the pulse P2*e* does not overlap the pulse P1*e*.

Further, the interval "b" may be determined in the range of 1H<b<2H-PW+(1H-a). For example, the pulse P3*e* defining the interval "b" may occur later than in the embodiment of FIG. 6, but the interval "b" is smaller than 2H-PW such that the pulse P3*e* does not overlap the next most adjacent pulse of the second clock signal. However, a margin value (1H-a) may be further added to the interval "b" as the extinction time of the second pulse P12 become faster.

Because pulses P14, P15, and P16 of light-emitting signals of fourth to sixth light-emitting lines E4, E5, and E6 may be adjusted to have the same shape as pulses P11, P12 and P13 of light-emitting signals of first to third light-emitting lines E1, E2, and E3, respectively, a duplicate description will be omitted.

An interval "c" between extinction times of the third pulse P13 and the fourth pulse P14 may be in a range of PW<c<1H in a manner similar to the case of the interval "a".

According to an embodiment of the present disclosure, because cycles of falling transition times of light-emitting signals are not constant, there may be an advantage that an EMI noise is dispersed at various frequencies, and a noise peak value is reduced.

In another embodiment of the present disclosure, the interval between the extinction times of the first and second pulses P11 and P12 may be longer than the interval between the extinction times of the second and third pulses P12 and P13. Another embodiment of the present disclosure can also be implemented by controlling the timing of the pulses of the clock signals applied to the clock lines CLK1' and CLK2', and may achieve substantially the same effects as those described above.

Figure 9:
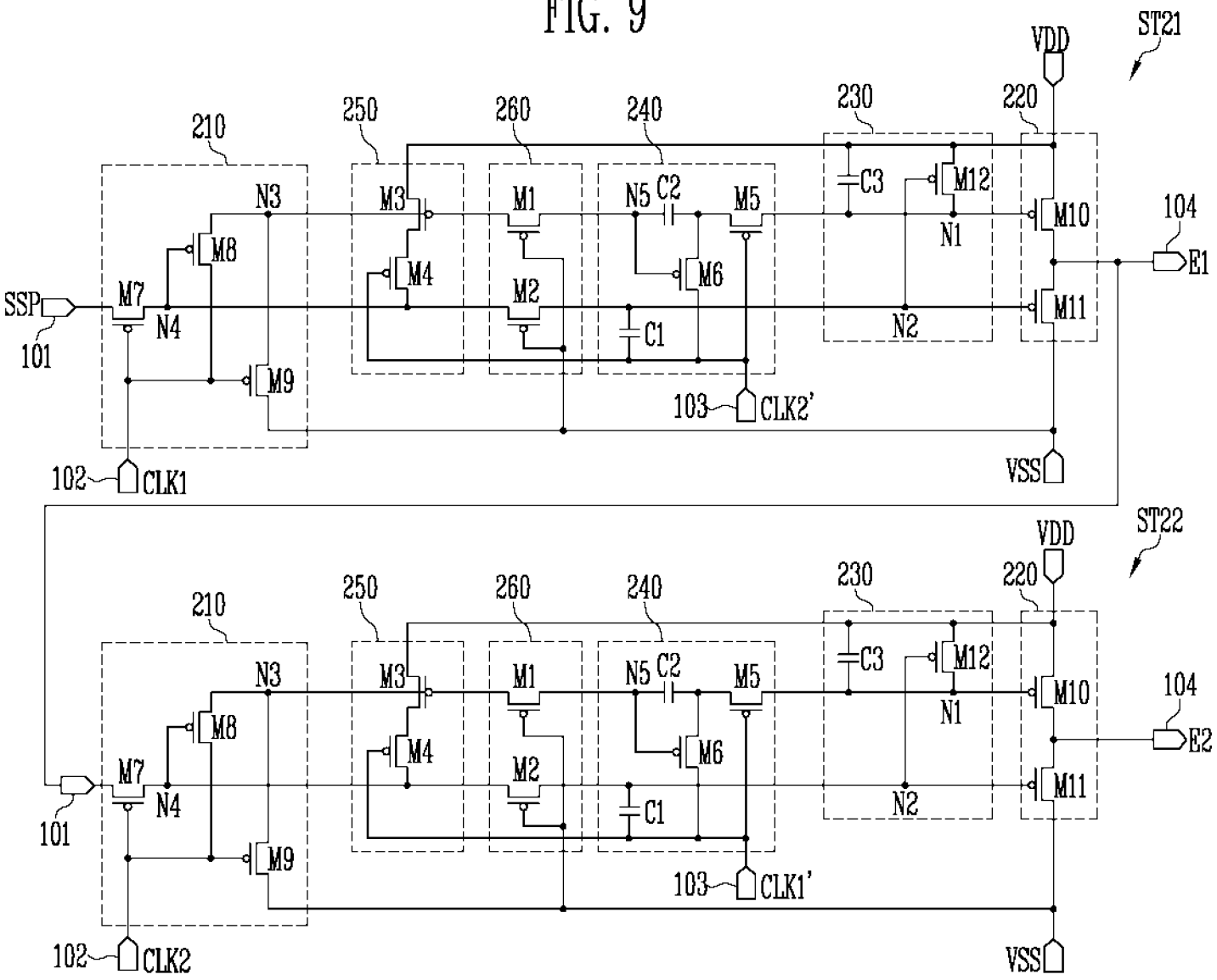
FIG. 9 is a drawing for illustrating light-emitting stages according to another embodiment of the present disclosure.

FIG. 9 is a drawing for illustrating light-emitting stages according to another embodiment of the present disclosure.

Referring to FIG. 9, light-emitting stages ST21 and ST22 are different from the light-emitting stages ST1 and ST2 of FIG. 5 in that the first clock line CLK1' and the second clock line CLK2' are connected to third input terminals 103 of the light-emitting stages ST21 and ST22, respectively.

That is, the emission driver 30 of FIG. 9 uses four clock lines CLK1, CLK2, CLK1', and CLK2'. As described in FIG. 6, the clock signal applied to the third input terminal 103 of each light-emitting stage defines the generation time of the pulse of the corresponding light-emitting signal, and the clock signal applied to the second input terminal 102 defines the extinction of the pulse of the corresponding light-emitting signal.

In an embodiment of the present disclosure, the timing of the pulses of the clock signals applied to the clock lines CLK1 and CLK2 connected to the second input terminal 102 may be the same as the timing shown in FIG. 6. Therefore, the generation times of pulses of light-emitting signals may be the same as the extinction times shown in FIG. 6.

However, by controlling the timing of the pulses of the clock signals applied to the clock lines CLK1' and CLK2' connected to the third input terminal 103, the generation times of the pulses of the light-emitting signals may be controlled.

Figure 10:
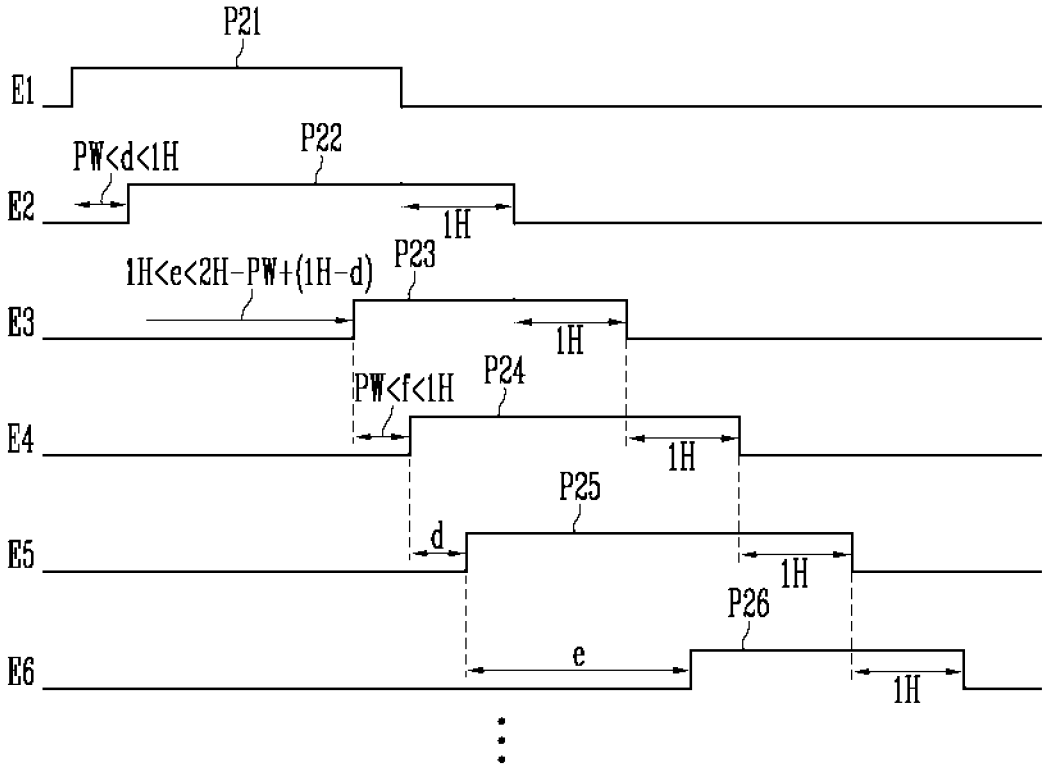
FIG. 10 is a drawing for illustrating a driving method of light-emitting stages according to another embodiment of the present disclosure.

FIG. 10 is a drawing for illustrating a driving method of light-emitting stages according to another embodiment of the present disclosure.

Referring to FIG. 10, the interval between the extinction times of the first and second pulses P21 and P22 is the same as the interval between the extinction times of the second and third pulses P22 and P23. For example, the interval between the extinction times of the first and second pulses P21 and P22 and the interval between the extinction times of the second and third pulses P22 and P23 may be one horizontal cycle 1H.

However, in the present embodiment, an interval between the generation times of the first and second pulses P21 and P22 is different from an interval between the generation times of the second and third pulses P22 and P23. For example, the interval between the generation times of the first and second pulses P21 and P22 may be shorter than the interval between the generation times of the second and third pulses P22 and P23. For example, an interval "d" between the generation times of the first and second pulses P21 and P22 may be less than one horizontal cycle 1H. At this time, an interval "e" between the generation times of the second and third pulses P22 and P23 may be more than one horizontal period 1H.

However, as described in a driving method of FIG. 6, there may be some limitations in controlling the timing of the pulses of the first and second clock signals. For example, the interval "d" may be in a range of PW<d<1H, the interval "e" may be in a range of 1H<e<2H−PW+(1H-d), and an interval "f" may be in a range of PW<f<1H. A duplicate description thereof will be omitted.

Because pulses P24, P25, and P26 of light-emitting signals of fourth to sixth light-emitting lines E4, E5, and E6 may be adjusted to have the same shape as pulses P21, P22, and P23 of light-emitting signals of first to third light-emitting lines E1, E2 and E3, respectively, a duplicate description will be omitted.

According to an embodiment of the present disclosure, because cycles of rising transition times of light-emitting signals are not constant, there is an advantage that an EMI noise is dispersed at various frequencies, and a noise peak value is reduced.

Conversely, in another embodiment of the present disclosure, the interval between the extinction times of the first and second pulses P21 and P22 may be longer than the interval between the extinction times of the second and third pulses P22 and P23. Another embodiment of the present disclosure can also be implemented by controlling the timing of the pulses of the clock signals applied to the clock lines CLK1' and CLK2', and may achieve substantially the same effects as those described above.

Figure 11:
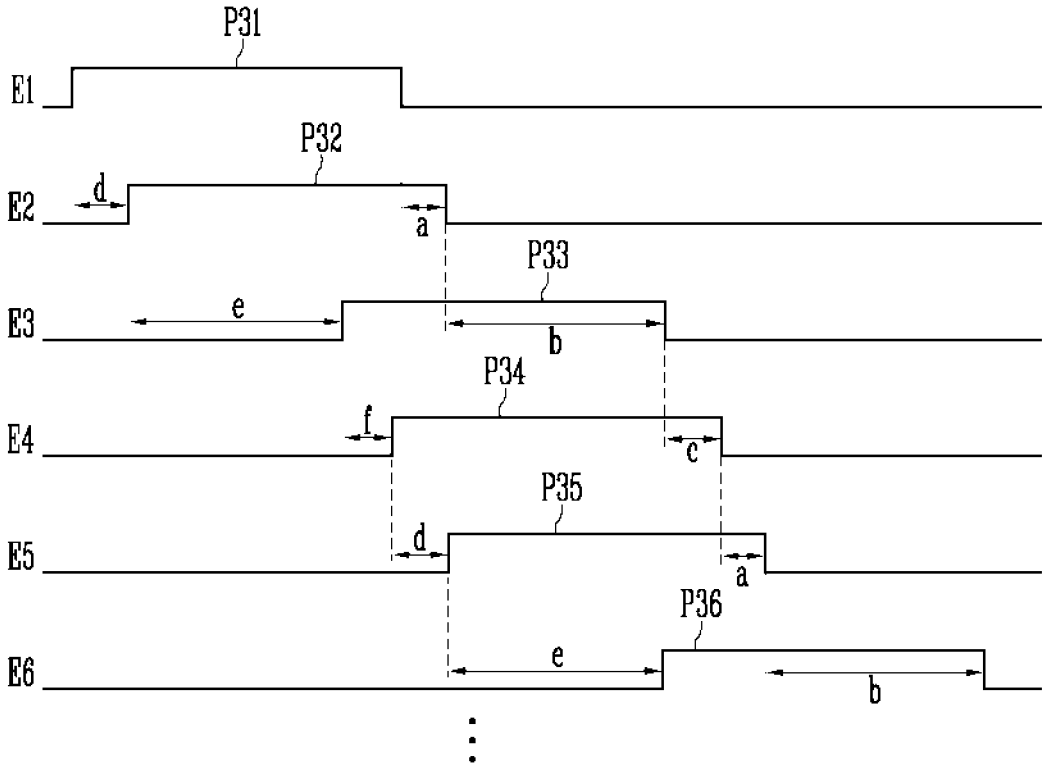
FIG. 11 is a drawing for illustrating a driving method of light-emitting stages according to another embodiment of the present disclosure.

FIG. 11 is a drawing for illustrating a driving method of light-emitting stages according to another embodiment of the present disclosure.

In the present embodiment, the interval between the beginnings of the first and second pulses of P31 and P32 is different from the interval between the beginnings of the second and third pulses of P32 and P33. In addition, the interval between the extinction times of the first and second pulses P31 and P32 is different from the interval between the extinction times of the second and third pulses P32 and P33. At this time, the first and third light-emitting stages may be the closest light-emitting stages to the second light-emitting stage.

In the present embodiment, the extinction times of the pulses P31 to P36 are similar to those described with respect to FIG. 8, and the generation times of the pulses P31 to P36 are similar to those described with respect to FIG. 10.

According to an embodiment of the present disclosure, because cycles of the rising transition times and the falling transition times of light-emitting signals are not constant, there is an advantage that an EMI noise is dispersed at various frequencies and a noise peak value may be reduced.

The drawings and the description of the present disclosure is intended to be illustrative, they were not used to limit the meaning or the scope of the present disclosure described in claims, but merely used to explain the present disclosure. Accordingly, a person having ordinary skill in the art will understand from the above that various modifications and other equivalent embodiments are also possible. Hence, the real protective scope of the present disclosure shall be determined by the technical scope of the accompanying claims, with functional equivalents thereof to be include therein.

| Description of Some of the Reference Characters | | |
|---|---|---|
| 10: scan driver | 20: data driver | 30: emission driver |
| 40: display | 50: pixel | 60: timing controller |

What is claimed is:

1. A display device comprising:

a first pixel comprising a first light-emitting diode, and a first light-emitting transistor for transferring a driving current to the first light-emitting diode when the first light-emitting transistor is turned on;

a second pixel comprising a second light-emitting diode, and a second light-emitting transistor for transferring a driving current to the second light-emitting diode when the second light-emitting transistor is turned on;

a third pixel comprising a third light-emitting diode, and a third light-emitting transistor for transferring a driving current to the third light-emitting diode when the third light-emitting transistor is turned on;

a first light-emitting stage that is configured to apply a first light-emitting signal comprising a first pulse at a turn-off level to a gate electrode of the first light-emitting transistor;

a second light-emitting stage that is configured to apply a second light-emitting signal comprising a second pulse at a turn-off level to a gate electrode of the second light-emitting transistor; and a third light-emitting stage that is configured to apply a third light-emitting signal comprising a third pulse at a turn-off level to a gate electrode of the third light-emitting transistor, wherein an interval between generation times of the first and second pulses is the same as an interval between generation times of the second and third pulses, and wherein an interval between extinction times of the first and second pulses is different from an interval between extinction times of the second and third pulses.

2. The display device of claim 1, wherein the interval between the extinction times of the first and second pulses is shorter than the interval between the extinction times of the second and third pulses.

3. The display device of claim 1, wherein the interval between the extinction times of the first and second pulses is longer than the interval between the extinction times of the second and third pulses.

4. The display device of claim 2, wherein the first, second, and third light-emitting stages are configured to receive a first clock signal and a second clock signal, wherein the generation time of the first pulse is synchronized with a pulse of the second clock signal, wherein the extinction time of the first pulse is synchronized with a pulse of the first clock signal, wherein the generation time of the second pulse is synchronized with a pulse of the first clock signal, wherein the extinction time of the second pulse is synchronized with a pulse of the second clock signal, wherein the generation time of the third pulse is synchronized with a pulse of the second clock signal, and wherein the extinction time of the third pulse is synchronized with a pulse of the first clock signal.

5. The display device of claim 4, wherein the pulses of the first clock signal and the second clock signal synchronized with the generation times and the extinction times of the first, second, and third pulses are different each other.

6. A display device comprising:

a first pixel comprising a first light-emitting diode, and a first light-emitting transistor for transferring a driving current to the first light-emitting diode when the first light-emitting transistor is turned on;

a second pixel comprising a second light-emitting diode, and a second light-emitting transistor for transferring a driving current to the second light-emitting diode when the second light-emitting transistor is turned on;

a third pixel comprising a third light-emitting diode, and a third light-emitting transistor for transferring a driving current to the third light-emitting diode when the third light-emitting transistor is turned on;

a first light-emitting stage that is configured to apply a first light-emitting signal comprising a first pulse at a turn-off level to a gate electrode of the first light-emitting transistor;

a second light-emitting stage that is configured to apply a second light-emitting signal comprising a second pulse at a turn-off level to a gate electrode of the second light-emitting transistor; and a third light-emitting stage that is configured to apply a third light-emitting signal comprising a third pulse at a turn-off level to a gate electrode of the third light-emitting transistor, wherein an interval between generation times of the first and second pulses is different from an interval between generation times of the second and third pulses, and wherein an interval between extinction times of the first and second pulses is the same as an interval between extinction times of the second and third pulses.

7. The display device of claim 6, wherein the interval between the generation times of the first and second pulses is shorter than the interval between the generation times of the second and third pulses.

8. The display device of claim 6, wherein the interval between the generation times of the first and second pulses is longer than the interval between the generation times of the second and third pulses.

9. The display device of claim 7, wherein the first, second, and third light-emitting stages are configured to receive a first clock signal and a second clock signal, wherein the generation time of the first pulse is synchronized with a pulse of the second clock signal, wherein the extinction time of the first pulse is synchronized with a pulse of the first clock signal, wherein the generation time of the second pulse is synchronized with a pulse of the first clock signal, wherein the extinction time of the second pulse is synchronized with a pulse of the second clock signal, wherein the generation time of the third pulse is synchronized with a pulse of the second clock signal, and wherein the extinction time of the third pulse is synchronized with a pulse of the first clock signal.

10. The display device of claim 9, wherein the pulses of the first clock signal and the second clock signal that are respectively synchronized with the generation times and the extinction times of the first, second, and third pulses are different each other.

11. A display device comprising:

a first pixel comprising a first light-emitting diode, and a first light-emitting transistor for transferring a driving current to the first light-emitting diode when the first light-emitting transistor is turned on;

a second pixel comprising a second light-emitting diode, and a second light-emitting transistor for transferring a driving current to the second light-emitting diode when the second light-emitting transistor is turned on;

a third pixel comprising a third light-emitting diode, and a third light-emitting transistor for transferring a driving current to the third light-emitting diode when the third light-emitting transistor is turned on;

a first light-emitting stage that is configured to apply a first light-emitting signal comprising a first pulse at a turn-off level to a gate electrode of the first light-emitting transistor;

a second light-emitting stage that is configured to apply a second light-emitting signal comprising a second pulse at a turn-off level to a gate electrode of the second light-emitting transistor; and a third light-emitting stage that is configured to apply a third light-emitting signal comprising a third pulse at a turn-off level to a gate electrode of the third light-emitting transistor, wherein an interval between generation times of the first and second pulses is different from an interval between generation times of the second and third pulses, wherein an interval between extinction times of the first and second pulses is different from an interval between extinction times of the second and third pulses, and wherein the first and third light-emitting stages are light-emitting stages that are closest to the second light-emitting stage.

12. The display device of claim 11, wherein the interval between the extinction times of the first and second pulses is shorter than the interval between the extinction times of the second and third pulses.

13. The display device of claim 12, wherein the interval between the generation times of the first and second pulses is shorter than the interval between the generation times of the second and third pulses.

14. The display device of claim 13, wherein the first, second, and third light-emitting stages are configured to receive a first clock signal and a second clock signal, wherein the generation time of the first pulse is synchronized with a pulse of the second clock signal, wherein the extinction time of the first pulse is synchronized with a pulse of the first clock signal, wherein the generation time of the second pulse is synchronized with a pulse of the first clock signal, wherein the extinction time of the second pulse is synchronized with a pulse of the second clock signal, wherein the generation time of the third pulse is synchronized with a pulse of the second clock signal, and wherein the extinction time of the third pulse is synchronized with a pulse of the first clock signal.

15. The display device of claim 14, wherein the pulses of the first clock signal and the second clock signal that are respectively synchronized with the generation times and the extinction times of the first, second, and third pulses are different each other.

16. The display device of claim 11, wherein the interval between the extinction times of the first and second pulses is longer than the interval between the extinction times of the second and third pulses.

17. The display device of claim 16, wherein the interval between the generation times of the first and second pulses is longer than the interval between the generation times of the second and third pulses.

18. The display device of claim 17, wherein the first, second, and third light-emitting stages are configured to receive a first clock signal and a second clock signal, wherein the generation time of the first pulse is synchronized with a pulse of the first clock signal, wherein the extinction time of the first pulse is synchronized with a pulse of the second clock signal, wherein the generation time of the second pulse is synchronized with a pulse of the second clock signal, wherein the extinction time of the second pulse is synchronized with a pulse of the first clock signal, wherein the generation time of the third pulse is synchronized with a pulse of the first clock signal, and wherein the extinction time of the third pulse is synchronized with a pulse of the second clock signal.

19. The display device of claim 18, wherein the pulses of the first clock signal and the second clock signal that are respectively synchronized with the generation times and the extinction times of the first, second, and third pulses are different each other.

20. The display device of claim 17, wherein a width of each of the first, second, and third pulses is the same.

* * * * *